US009616485B2

(12) United States Patent
Ogura et al.

(10) Patent No.: US 9,616,485 B2
(45) Date of Patent: Apr. 11, 2017

(54) METAL STRIP

(71) Applicant: JFE STEEL CORPORATION, Tokyo (JP)

(72) Inventors: Takahiko Ogura, Tokyo (JP); Hiroshi Shigeta, Tokyo (JP); Yoshimitsu Fukui, Tokyo (JP); Yoshitsugu Iijima, Tokyo (JP); Kei Mikami, Tokyo (JP); Yasuhiro Matsuki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 284 days.

(21) Appl. No.: 14/367,804

(22) PCT Filed: Dec. 20, 2012

(86) PCT No.: PCT/JP2012/008145
§ 371 (c)(1),
(2) Date: Jun. 20, 2014

(87) PCT Pub. No.: WO2013/094204
PCT Pub. Date: Jun. 27, 2013

(65) Prior Publication Data

US 2015/0328675 A1 Nov. 19, 2015

(30) Foreign Application Priority Data

Dec. 21, 2011 (JP) ..... 2011-280466

(51) Int. Cl.
*B21H 7/00* (2006.01)
*C22C 38/50* (2006.01)
(Continued)

(52) U.S. Cl.
CPC ..... *B21H 7/00* (2013.01); *B21B 37/24* (2013.01); *B21C 37/0803* (2013.01);
(Continued)

(58) Field of Classification Search
CPC .... B21H 1/18; B21H 1/20; B21H 1/22; B21B 37/24; B21B 37/26; E04C 2003/0456;
(Continued)

(56) References Cited

U.S. PATENT DOCUMENTS 4,603,806 A 8/1986 Watanabe et al.

FOREIGN PATENT DOCUMENTS

CN 101633003 1/2010
EP 0133705 3/1985
(Continued)

OTHER PUBLICATIONS

English Translation of JP2006-272440 dated Jun. 14, 2016.*
(Continued)

*Primary Examiner* — Adam Krupicka
(74) *Attorney, Agent, or Firm* — Young & Thompson

(57) ABSTRACT

Provided is a metal strip for a pipe with which the weight of a pipe can be reduced while maintaining the strength of a joint portion that tends to be structurally the weakest. A metal strip L is formed by rolling. The thickness of each of a head end portion 1*a* and a tail end portion 1*b*, which are longitudinal end portions 1, is greater than the thickness of an intermediate portion excluding the longitudinal end portions 1. The metal strips are connected to each other in series by welding, and a pipe is made by performing a pipe-forming operation.

8 Claims, 2 Drawing Sheets

(51) Int. Cl.

| | |
|---|---|
| ***C22C 38/48*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***B21C 37/08*** | (2006.01) |
| ***B21C 37/083*** | (2006.01) |
| ***B21B 37/24*** | (2006.01) |
| *B21B 1/22* | (2006.01) |

(52) U.S. Cl.
CPC ..... *B21C 37/083* (2013.01); *C22C 38/001* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *B21B 1/22* (2013.01); *B21B 2001/225* (2013.01); *B21B 2205/02* (2013.01); *Y10T 428/12389* (2015.01)

(58) Field of Classification Search
CPC ..... E04C 2003/0443; Y10T 428/12375; Y10T 428/12389
See application file for complete search history.

(56) References Cited

FOREIGN PATENT DOCUMENTS

| | | |
|---|---|---|
| JP | 59-45006 | 3/1984 |
| JP | 60-3904 | 1/1985 |
| JP | 61-103603 | 5/1986 |
| JP | 61-172603 | 8/1986 |
| JP | 62-54505 | 3/1987 |
| JP | 07-51743 | 2/1995 |
| JP | 2002-326589 | 11/2002 |
| JP | 2003-320404 | 11/2003 |
| JP | 2006-272440 | 10/2006 |

OTHER PUBLICATIONS

International Search Report, PCT/JP2012/008145, Jan. 29, 2013.
Extended European search report, dated May 4, 2015, in corresponding European Patent Application No. 12859517.0.

* cited by examiner

METAL STRIP

TECHNICAL FIELD

The present invention relates to a metal strip that is made of a material such as steel or aluminum and that is preferably used for manufacturing a pipe body and a pipe.

In the present specification, the term "pipe" refers to a product made by connecting two or more pipe bodies in series.

BACKGROUND ART

A hot-rolled steel sheet is usually manufactured by rolling so that variation in the thickness of the steel sheet along the longitudinal direction is minimized in one coil (one strip of the hot-rolled sheet). Thus, a hot-rolled steel sheet is strip-shaped and has a uniform thickness along the longitudinal direction. After hot rolling, pickling may be performed on a hot-rolled steel sheet, if necessary. In the following description, a hot-rolled steel sheet or a product made by slitting a hot-rolled steel sheet in the longitudinal direction will be referred to as a "steel strip".

Such a steel strip is used, for example, to form an oil-well cleaning pipe. An oil-well cleaning pipe is manufactured by successively joining a plurality of pipe bodies, which have been made from the steel strips, to each other by welding, or by joining the steel strips to each other by welding and then performing a pipe-forming operation. The oil-well cleaning pipe is usually manufactured so that the diameter and thickness decrease toward one end. The reason for manufacturing the pipe in this way is to reduce the suspended weight. An oil-well cleaning pipe is coiled around a reel and transported to a site. At the site, the oil-well cleaning pipe is uncoiled or coiled as necessary.

When a plurality of pipe bodies are made from steel strips having a uniform thickness along the longitudinal direction and a long oil-well cleaning pipe is manufactured by butt-welding the plurality of pipe bodies and if the oil-well cleaning pipe is designed so that the diameter decreases toward one end, steps are formed at butt-joint portions of the pipe bodies. Such an oil-well cleaning pipe has a problem of a short lifetime, because a crack is likely to occur at a step of a butt-joint portion while the pipe which is coiled around a reel is uncoiled and coiled repeatedly.

When an oil-well cleaning pipe is manufactured by butt-welding a plurality of steel pipes made from steel strips having the same thickness, the suspended weight of the oil-well cleaning pipe is increased, and therefore it becomes necessary to increase the strength by, for example, increasing the grades of the material of the steel pipe. Moreover, because the weight of the entirety of the oil-well cleaning pipe is increased in this case, a problem occurs in that it is necessary to reduce the length of the oil-well cleaning pipe. Furthermore, an oil-well cleaning pipe may be transported along a road having a weight limitation of transport vehicle or the like, and it is preferable that an increase in the weight of the oil-well cleaning pipe be suppressed also for this reason.

A steel strip described in Patent Literature 1 is an example of existing technologies for addressing such problems. The steel strip described in Patent Literature 1 is a steel strip having a thickness that changes at a constant gradient along the longitudinal direction. In other words, the thickness of the steel strip gradually decreases at a constant rate from one of the longitudinal end portions to the other longitudinal end portion.

In the case of manufacturing an oil-well cleaning pipe, which is a long steel pipe, by joining steel pipes made from steel strips described in Patent Literature 1 to each other by successively butt-welding the steel pipes, the steel strips are manufactured so that the diameter of the tail end portion of a first steel pipe (on the small diameter side) and the diameter of the head end portion of a second steel pipe (on the large diameter side) becomes the same as each other, and the tail end portion of the first steel pipe and the head end portion of the second steel pipe are butt-welded. By repeating such a process, a long steel pipe (oil-well cleaning pipe) can be manufactured. Thus, it is possible to manufacture a long steel pipe that has a thickness decreasing toward one end and that does not have steps at connection portions (butt-welded portions).

Patent Literature 2 also describes a steel plate having a thickness that varies along the longitudinal direction. However, the steel plate described in Patent Literature 2 is a thick steel plate that is not to be coiled and that is not a steel sheet used as a coil or as a steel strip. In other words, it is different from a metal strip to which the present invention is related.

CITATION LIST

Patent Literature

PTL 1: Japanese Unexamined Patent Application Publication No. 7-51743

PTL 2: Japanese Unexamined Patent Application Publication No. 2003-320404

SUMMARY OF INVENTION

Technical Problem

In the steel strips described in Patent Literature 1, the rate of change in the thickness is constant. Therefore, even if the thickness at the head end portion (on the thick side) is the same, the thickness at the tail end portion (on the thin side) varies depending on the length of the rolled sheet. Moreover, it is necessary to manufacture a steel strip for a second steel pipe to be connected to a first steel pipe by setting the thickness of the head end portion of the steel strip beforehand in accordance with the thickness of the first steel pipe. Such a steel strip lacks versatility.

Although the steel pipe described above does not have steps at connection portions and it is possible to eliminate portions where the thickness sharply changes over the entire length of the long steel pipe, the connection portions are structurally weak even with the same thickness. Therefore, although the steel pipe has a lifetime longer than that of a pipe having steps at the connection portions, the steel pipe has a problem in that crack is likely to occur at the connection portions while the steel pipe is repeatedly uncoiled and coiled.

An object of the present invention, which has been achieved with consideration of the matters described above, is to provide a metal strip for a pipe with which the weight of a pipe can be reduced while maintaining the strength of a joint portion that tends to be structurally the weakest.

Solution to Problem

The gist of the present invention, which has been achieved on the basis of the findings described above, is as follows.

[1] In a metal strip formed by rolling, a thickness of each of a head end portion and a tail end portion, which are longitudinal end portions, is greater than a thickness of an intermediate portion excluding the longitudinal end portions.

[2] In the metal strip described in [1], the metal strip includes the longitudinal end portions, a longitudinal middle portion located between the longitudinal end portions, and two inclined portions connecting the longitudinal end portions to the longitudinal middle portion; and thicknesses of the two inclined portions continuously and monotonically decrease from the longitudinal end portions toward the longitudinal middle portion.

[3] In the metal strip described in [2], the thickness of at least one of two end portions, which are the longitudinal end portions of the metal strip, continuously and monotonically decreases from an end surface thereof toward the inclined portion connected thereto; and a rate of change at which the thickness of the at least one of the two end portions continuously and monotonically decreases along the longitudinal direction is smaller than a rate of change at which the thickness of a corresponding one of the inclined portions monotonically decreases.

[4] In the metal strip described in [2] or [3], the metal strip has a thickness along the longitudinal direction such that a ratio ((A−B)/A) is 7% or more and 50% or less, where A is a maximum thickness of the longitudinal end portions and B is a minimum thickness of the longitudinal middle portion.

[5] In the metal strip described in any one of [2] to [4], a rate of change in the thickness of each of the inclined portions along the longitudinal direction is 0.001 [mm/m] or more and 0.1 [mm/m] or less.

[6] In the metal strip described in any one of [2] to [5], a ratio of a maximum deviation of the thickness of the metal strip along the longitudinal direction to the thickness of the metal strip is 5% or less.

[7] The metal strip described in any one of [1] to [6], which is formed by hot rolling.

[8] The metal strip described in any one of [1] to [7], which is a metal strip having a thickness in the range of 1.0 to 8.0 mm and a total length in the range of 80 to 1000 m.

The material of the metal strip is not particularly limited, and may be steel or aluminum.

Advantageous Effects of Invention

According to the present invention, a metal strip is formed so that the end portions of the metal strip are relatively thick and the intermediate portion of the metal strip is relatively thin. By forming a pipe from such metal strips, the strength of the longitudinal end portions, which become joint portions, can be increased while reducing the weight of the entirety of the pipe.

As a result, it is possible to provide a metal strip with which the weight of a pipe can be reduced while maintaining the strength of a joint portion that would tend to be structurally the weakest.

DESCRIPTION OF EMBODIMENTS

Next, an embodiment of the present invention will be described with reference to the drawings.

Figure 1:
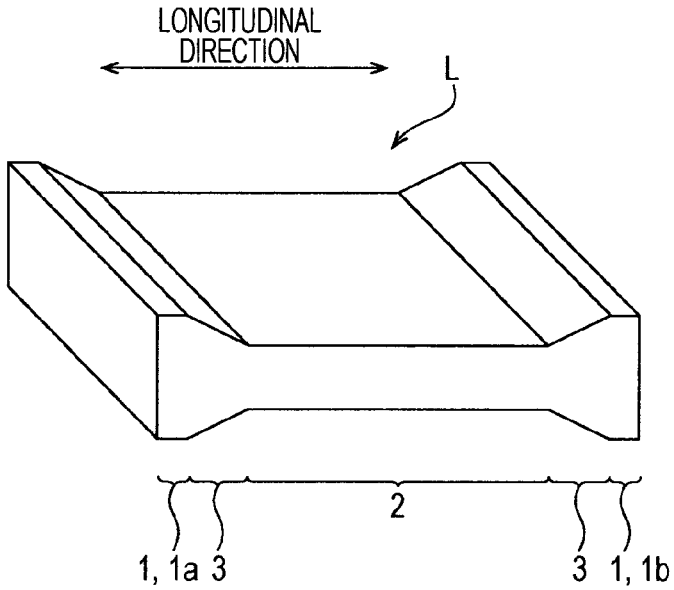
FIG. 1 is a schematic perspective view illustrating a metal strip according to an embodiment of the present invention.

FIG. 1 is a schematic perspective view illustrating an example of a metal strip according to the present embodiment. In each of the figures, the dimension in the longitudinal direction (rolling direction) is considerably reduced.

(Structure of Metal Strip)

In the following description, steel will be used as an example of the material of a metal strip. However, the material of a metal strip according to the present invention is not limited to steel, and may be any metal material that can be hot-rolled, such as aluminum or copper.

As illustrated in FIG. 1, a metal strip L according to the present embodiment includes a head end portion 1*a* and a tail end portion 1*b*, which are longitudinal end portions 1; a longitudinal middle portion 2, which is located between the longitudinal end portions 1; and two inclined portions 3 connecting the longitudinal end portions 1*a* and 1*b* to the longitudinal middle portion 2. The metal strip L is hot-rolled so as to have a desired thickness in profile. Then, the metal strip L is coiled by a coiler to form a coil. As necessary, pickling treatment may be performed on the coil after rolling. The length of the metal strip L is, for example, in the range of 50 m to 2500 m.

The metal strip L is manufactured by rolling so as to have a predetermined thickness in the range of, for example, 1.0 mm to 30.0 mm. In the present embodiment, the thickness of each of the longitudinal end portions 1 is set to be greater than the thickness of the longitudinal middle portion 2 and the thicknesses of the inclined portions 3. The longitudinal middle portion 2 and the inclined portions 3 correspond to an intermediate portion excluding the longitudinal end portions 1.

The metal strip L according to the present embodiment is a hot-rolled steel sheet manufactured by rolling as described above so that the thickness of the longitudinal middle portion 2 is uniform or substantially uniform along the longitudinal direction and so that the thicknesses of the inclined portions 3 gradually decrease from the longitudinal end portions toward ends of the longitudinal middle portion 2. Pickling treatment may be performed after hot rolling.

Figure 2:
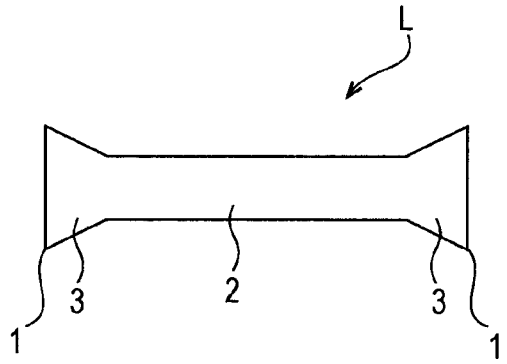
FIG. 2 is a schematic side view of a metal strip according to a modification.

The thicknesses of the longitudinal end portions 1 of the metal strip L and the thickness of the longitudinal middle portion 2 of the metal strip L are set so that the ratio ((A−B)/A) is 7% or more and 50% or less, where A is the maximum thickness of the longitudinal end portions 1, and B is the thickness of the longitudinal middle portion 2. In the present specification, the ratio ((A−B)/A) will be referred to as a thickness deviation. In FIG. 1, A is the thickness of the longitudinal end portions 1, because the thickness of the longitudinal end portions 1 is uniform. In a case where the thicknesses of the longitudinal end portions 1 change as in FIG. 2, A is the maximum thickness of the longitudinal end portions 1 (the thicknesses at the end surfaces in FIG. 2).

Figure 3:
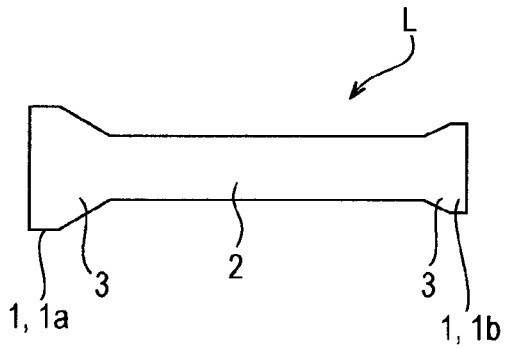
FIG. 3 is a schematic side view of a metal strip according to a modification.

As illustrated in FIG. 3, it is not necessary that the maximum thicknesses of the head end portion 1*a* and the tail end portion 1*b* in the longitudinal direction be the same. The maximum thickness of each of the longitudinal end portions 1*a* and 1*b* is set so as to satisfy the condition described above.

The longitudinal middle portion 2 forms the body of the metal strip L, that is, the body of a pipe body to be made from the metal strip L. Therefore, the thickness of the longitudinal middle portion 2 is determined on the basis of the material of the metal strip L, the diameter of the pipe body to be made and the like so that a strength required for an intended use can be obtained. Subsequently, for example, by using the strength of the longitudinal middle portion 2 as a benchmark, the maximum thickness of the longitudinal end portions may be determined so that the joint strength at the longitudinal end portions, which will serve as joint portions, becomes close to the strength of the longitudinal middle portion 2, in particular, the strength of a part of the longitudinal middle portion 2 near the longitudinal end portions.

Here, since the strength of a structure can be evaluated, for example, by the moment of inertia of area, an increase in the strength is proportional to the square of the thickness.

The thickness deviation is set to be 7% or more and 50% or less for the following reasons. The lower limit of thickness deviation is set to be 7% or greater, because the effect of weight reduction is small and the effect of increasing the joint strength at connection portions is small if the thickness deviation is less than 7%. The upper limit of thickness deviation is set to be 50% from the view point of preventing occurrence of buckling, because the difference between the strength of the longitudinal middle portion 2 and the joint strength at the connection portions becomes large if the thickness deviation is greater than 50%, although it may be contribute to weight reduction. It is preferable that the thickness deviation be 10% or more and 30% or less. Preferably, variation in the strength along the longitudinal direction is suppressed.

Variation in the thickness of the inclined portion 3 along the longitudinal direction is set to be in the range of 0.001 [mm/m] or more and 0.1 [mm/m] or less.

The upper limit of the variation of the inclined portion 3 is set to be 0.1 [mm/m] for the following reason. As the variation along the longitudinal direction increases, the variation in the strength along the longitudinal direction increases, and the risk of occurrence of buckling increases. From this viewpoint, the risk of occurrence of buckling can be suppressed if the variation is 0.1 [mm/m] or less.

The lower limit of the variation is set to be 0.001 [mm/m] because, as the variation decreases, the length of the longitudinal middle portion 2, which forms the body of the metal strip L and the body of a pipe body to be made from the metal strip L, decreases, and thereby the effect of weight reduction is reduced. Therefore, the lower limit is set to be 0.001 [mm/m] or greater.

Even when the end portions of a metal strip are formed so as to be thick in hot rolling, if the thickened end portions are removed by pickling, slitting, or the like, such a metal strip is not a metal strip according to the present invention. A metal strip according to the present invention has longitudinal end portions that are thick when the metal strip is used as a product.

(Regarding Pipe Body and Pipe)

The metal strip L itself may be used as a steel strip, or a steel strip having an appropriate width may be made by slitting the metal strip L.

The steel strip is formed into a pipe body. Then, a long pipe is made by successively connecting a plurality of pipe bodies by butt-welding the ends of the pipe bodies to each other.

Alternatively, a long pipe may be manufactured by forming a pipe body while successively joining the steel strips by welding. Any existing method may be used to make a long pipe. For example, a pipe is continuously manufactured by roll forming as follows: while uncoiling a coiled steel strip, the steel strip is successively rolled to be formed into a U-shape and further into an O-shape; and ends of the steel strip in the width direction are continuously welded so as to close the O-shape. In this case, a long pipe is manufactured by successively welding a tail end portion of a preceding coil to a head end portion of the next coil.

(Advantages)

Figure 4:
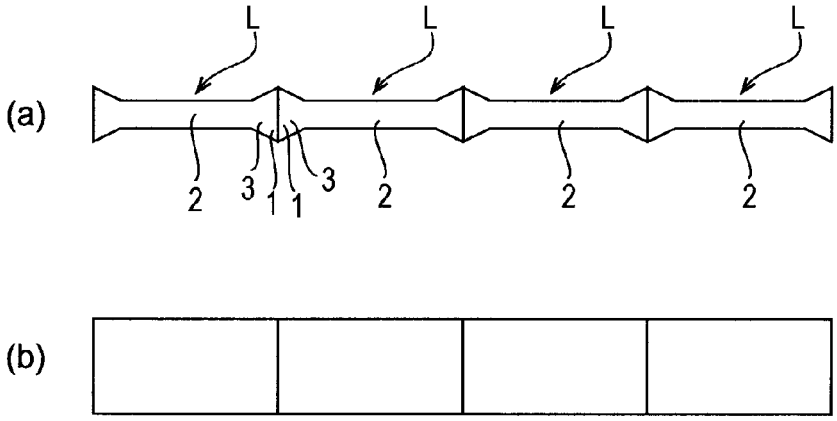
FIGS. 4(*a*) and 4(*b*) are each a schematic side view of a plurality of metal strips that are connected to each other, FIG. 4(*a*) showing a case where metal strips according to the present invention are used, and FIG. 4(*b*) showing a case where metal strips according to a comparative example are used.

FIG. 4(*a*) is a schematic side view of a case where steel strips each having the aforementioned thickness profile are successively welded on the basis of the present embodiment. FIG. 4(*b*) illustrates a comparative example in a case where steel strips, which have end portions having a thickness that is the same as that of the steel strips in FIG. 4(A) and that is uniform along the longitudinal direction, are successively joined to each other by welding.

When a pipe body is made by forming a steel strip into an O-shape, the diameter of the pipe body is determined by the width of the steel strip and the thickness of the pipe is determined by the thickness of the steel strip. As can be seen from comparison between FIGS. 4(*a*) and 4(*b*), with the present embodiment (see FIG. 4(*a*)), a strength the same as that of the comparative example can be maintained at joint portions between the pipe bodies, while weight reduction can be achieved because the bodies of the pipe bodies (the longitudinal middle portions 2) are thin. In the steel strip according to the present embodiment, the thickness of the longitudinal middle portion 2 may be set to be an appropriate thickness with which a strength required for a pipe to be made from the steel strip can be obtained.

When forming a long pipe such as an oil-well cleaning pipe, by connecting the steel strips so that the thicknesses of the longitudinal middle portions 2 successively become smaller, the thickness of the pipe can be made smaller toward one end, that is, the weight of the pipe can be made smaller toward the end. Also in this case, by making the thicknesses of the longitudinal end portions 1 be the same, even when the thicknesses of the longitudinal middle portions 2 differ from each other, the steel strips can be butt-welded to each other so as to have no steps or so as to have only small steps therebetween. Note that, according to the present embodiment, it is not necessary to make the diameter of the pipe smaller toward one end even when making a long pipe such as an oil-well cleaning pipe, because the weight of each of the pipe bodies can be reduced. In other words, the shapes of metal strips, which will become the pipe bodies, may be the same.

Thus, weight reduction of the entire pipe can be achieved, while suppressing variation in the strength of the pipe along the longitudinal direction, including the strengths of welded joint portions.

MODIFICATIONS

Figure 5:
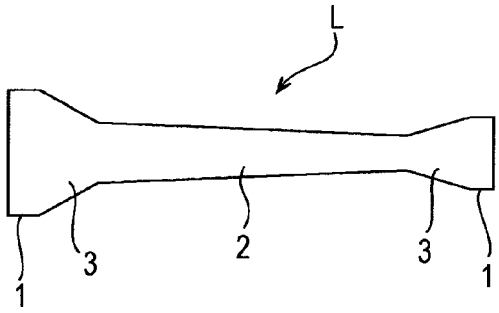
FIG. 5 is a schematic side view of a metal strip according to a modification.

In the embodiment, a case where the thickness of the longitudinal middle portion 2 is uniform or substantially uniform along the longitudinal direction is used as an example. However, it is not necessary that the thickness of the longitudinal middle portion 2 be uniform along the longitudinal direction. For example, as illustrated in FIG. 5, the longitudinal middle portion 2 may have a thickness that decreases at a constant gradient from the head end toward the tail end. In the case where the thickness of the longitudinal middle portion 2 along the longitudinal direction changes, it is preferable that variation in the thickness along the longitudinal direction be 0.1 [mm/m] or less. This is in order to suppress buckling, which may occur due to an increase in variation in the strength along the longitudinal direction, as described above.

In the embodiment, a case where a long pipe is made from the metal strips L is used as an example. Alternatively, a long structural element, such as a long beam, may be made by welding ends of a plurality of steel strips. Also in this case, the weight of the structural element can be reduced while maintaining the strength of welded portions which are structurally the weakest, because the thicknesses of portions excluding the welded portions are small. However, the present invention is particularly effective when it is applied to a long pipe. The long pipe is not limited to an oil-well cleaning pipe. The long pipe may be used as a beam or a column.

Example 1

Figure 6:
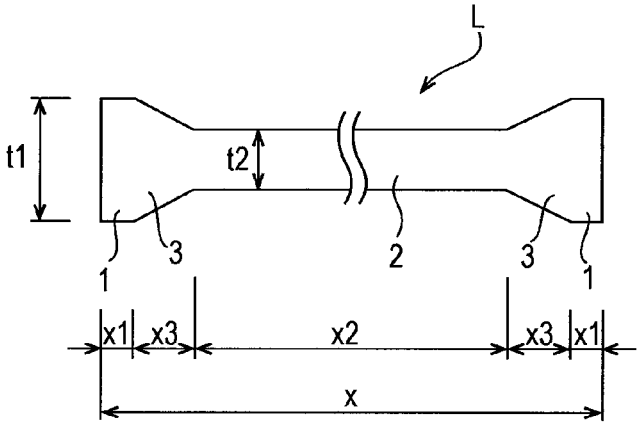
FIG. 6 is a side view of a metal strip used for describing EXAMPLE.

Referring to FIG. 6, examples of the embodiment will be described.

Metal strips A to I having the following dimensions were made from a material in accordance with API 5ST (corresponding to a hot steel sheet having a tensile strength of 600 to 700 MPa). The length X of each metal strip was 100 m, and the width of each metal strip was 1000 mm.

Each of the metal strips according to the present embodiment was made under the following conditions. A steel having the following composition was hot-rolled to form a metal strip, while setting the finishing temperature to be in the range of 820 to 920° C. and setting the coiling temperature to be in the range of 550 to 620° C.

The composition of the steel was, in mass %, C: 0.13%, Si: 0.2%, Mn: 0.7%, P: 0.02% or less, S: 0.005% or less, Sol.Al: 0.01-0.07%, Cr: 0.5%, Cu: 0.2%, Ni: 0.2%, Mo: 0.1%, Nb: 0.02%, Ti: 0.01%, N: 0.005% or less, and the balance being Fe and inevitable impurities.

metal strip A
- longitudinal end portions
- length x1: 1.0 m
- thickness t1: 5.18 mm
- longitudinal middle portion
- length x2: 78 m
- thickness t2: 4.45 mm
- inclined portion 3
- length x3: 10 m metal strip B
- longitudinal end portions
- length x1: 1.0 m
- thickness t1: 5.18 mm
- longitudinal middle portion
- length x2: 78 m
- thickness t2: 4.93 mm
- inclined portion 3
- length x3: 10 m metal strip C
- longitudinal end portions
- length x1: 1.0 m
- thickness t1: 5.18 mm
- longitudinal middle portion
- length x2: 84 m
- thickness t2: 4.45 mm
- inclined portion 3
- length x3: 7 m metal strip G
- longitudinal end portions
- length x1: 0.0 m
- thickness t1: 5.18 mm
- longitudinal middle portion
- length x2: 80 m
- thickness t2: 4.45 mm
- inclined portion 3
- length x3: 10 m metal strip H
- longitudinal end portions
- length x1: 0.0 m
- thickness t1: 5.18 mm
- longitudinal middle portion
- length x2: 80 m
- thickness t2: 4.93 mm
- inclined portion 3
- length x3: 10 m metal strip I
- longitudinal end portions
- length x1: 0.0 m
- thickness t1: 5.18 mm
- longitudinal middle portion 2
- length x2: 86 m
- thickness t2: 4.45 mm
- inclined portion 3
- length x3: 7 m In addition, metal strips D, E, and F for comparative examples, each having a uniform thickness along the longitudinal direction, were made from a material the same as above. The thicknesses of the metal strips were as follows.

metal strip D: 4.45 mm metal strip E: 4.93 mm metal strip F: 5.18 mm

For the metal strips A and G, (5.18−4.45)/5.18=0.14, that is, the thickness deviation along the longitudinal direction is 14%. Variation of the inclined portion 3 along the longitudinal direction is (5.18−4.45)/10=0.073 [mm/m].

For the metal strips B and H, (5.18−4.93)/5.18=0.048, that is, the thickness deviation along the longitudinal direction is 4.8%. Variation of the inclined portion 3 along the longitudinal direction is (5.18−4.93)/10=0.025 mm/m.

For the metal strips C and I, (5.18−4.45)/5.18=0.14, that is, the thickness deviation along the longitudinal direction is 14%. Variation of the inclined portion 3 along the longitudinal direction is (5.18−4.45)/7=0.104 mm/m.

For each the metal strips A to I, the same four metal strips were connected to each other in series by welding.

Then, the welded joint portion and portion where the thickness varied were cut into a specimen, and a tensile test was performed on each of the specimens. The specimens were prepared in accordance with JIS No. 5, and the test was performed with a testing method in accordance with JISZ2201.

In general, there is a correlation between the tensile strength and the fatigue strength of a material. Therefore, a tensile strength ratio can be regarded as a fatigue strength ratio.

Table 1 shows the results.

TABLE 1

| | Tensile Strength Ratio (where F is 1.0) | Weight Reduction Ratio (%) |
|---|---|---|
| A, G | 1.0 | 12 |
| B, H | 1.0 | 4 |
| C, I | 0.9 | 13 |
| D | 0.8 | 14 |
| E | 0.9 | 5 |
| F | 1.0 | 0 |

As can be seen from Table 1, in the cases where the metal strips A and G according to the present invention are used, weight reduction of 12% as compared the metal strips F can be achieved, while maintaining a tensile strength ratio the same as that of the metal strips F.

In contrast, in the cases where the metal strips B and H are used, weight reduction rate is smaller than that of the metal strips A and G, although a tensile strength ratio the same as that of the metal strips F can be maintained.

In the cases where the metal strips C and I are used, the tensile strength ratio is lower, that is, the fatigue strength ratio is lower than that of the metal strips A, G, and F, although the weight reduction rate about the same as that of the metal strips A and G can be achieved.

As can be seen from the results for the metal strips D, E, and F, as the thickness of the entirety of the metal strip decreases, the tensile strength ratio, that is, the fatigue strength ratio decreases, while the weight reduction ratio increases. In other words, in general, there is a trade-off between the tensile strength ratio (fatigue strength ratio) and the weight reduction ratio. In contrast, with the metal strips A and G according to the present invention, a significant weight reduction can be achieved without decreasing the tensile strength ratio (fatigue strength ratio).

As heretofore described, by making a long pipe from the metal strips L, which satisfy the range of the present invention, the lifetime of the pipe can be increased while achieving weight reduction.

REFERENCE SIGNS LIST

1 longitudinal end portion
1*a* head end portion
1*b* tail end portion
2 longitudinal middle portion
3 inclined portion
L metal strip

The invention claimed is:

1. A metal strip, comprising:

two longitudinal end portions, a longitudinal intermediate portion between the two longitudinal end portions, and two inclined portions connecting respective ones of the two longitudinal end portions to the longitudinal intermediate portion, each of the two longitudinal end portions having a thickness greater than a thickness of the longitudinal intermediate portion, each of the two inclined portions having a thickness that continuously and monotonically decreases from the respective one of the two longitudinal end portions to the longitudinal intermediate portion, the thickness of at least one of two longitudinal end portions continuously and monotonically decreases from an end surface thereof toward the inclined portion connected thereto, and a rate of change at which the thickness of the at least one of the two longitudinal end portions continuously and monotonically decreases along the longitudinal direction is smaller than a rate of change at which the thickness of the respective one of the two inclined portions decreases.

2. The metal strip according to claim 1, wherein the metal strip has a thickness along the longitudinal direction such that a ratio ((A−B)/A) is 7% or more and 50% or less, where A is a maximum thickness of the longitudinal end portions and B is a minimum thickness of the longitudinal intermediate portion.

3. The metal strip according to claim 1, wherein a rate of change in the thickness of each of the inclined portions along the longitudinal direction is 0.001 [mm/m] or more and 0.1 [mm/m] or less.

4. The metal strip according to claim 1, wherein the metal strip is formed by hot rolling.

5. A metal strip, comprising:

two longitudinal end portions, a longitudinal intermediate portion between the two longitudinal end portions, and two inclined portions connecting respective ones of the two longitudinal end portions to the longitudinal intermediate portion, one of the two longitudinal end portions having a maximum thickness greater than a maximum thickness of the other of the two longitudinal end portions, each of the two longitudinal end portions having a maximum thickness greater than a thickness of the longitudinal intermediate portion where the longitudinal intermediate portion is connected to a respective one of the two longitudinal end portions, and the intermediate portion having a thickness that decreases at a constant gradient from the one of the two longitudinal end portions with the greater maximum thickness to the other of the two longitudinal end portions.

6. The metal strip according to claim 5, wherein the metal strip has a thickness along the longitudinal direction such that a ratio ((A−B)/A) is 7% or more and 50% or less, where A is a maximum thickness of the two longitudinal end portions and B is a minimum thickness of the longitudinal intermediate portion.

7. The metal strip according to claim 5, wherein a rate of change in the thickness of each of the inclined portions along the longitudinal direction is 0.001 [mm/m] or more and 0.1 [mm/m] or less.

8. The metal strip according to claim 5, wherein the metal strip is formed by hot rolling.

* * * * *